US006491310B1

(12) United States Patent
Work

(10) Patent No.: US 6,491,310 B1
(45) Date of Patent: Dec. 10, 2002

(54) FREE SWIVELING MOUNT FOR SLIDING BOARD BOOT BINDINGS

(75) Inventor: Arlen Work, 512 Kim La., Waco, TX (US) 76706

(73) Assignee: Arlen Work, Robinson, TX (US)

( * ) Notice: Subject to any disclaimer, the term of this patent is extended or adjusted under 35 U.S.C. 154(b) by 0 days.

(21) Appl. No.: 09/461,101

(22) Filed: Dec. 14, 1999

Related U.S. Application Data

(60) Provisional application No. 60/112,253, filed on Dec. 14, 1998.

(51) Int. Cl.[7] ..... B62B 9/04; A63C 9/10

(52) U.S. Cl. ..... 280/14.24; 280/626; 280/629; 280/624

(58) Field of Search ..... 280/14.24, 618, 280/633, 613, 607, 629, 626, 624

(56) References Cited

U.S. PATENT DOCUMENTS 5,044,654 A * 9/1991 Meyer ..... 280/613
5,236,216 A * 8/1993 Ratzek ..... 280/607
5,553,883 A * 9/1996 Erb ..... 280/607
5,586,779 A * 12/1996 Dawes et al. ..... 280/14.24
5,826,910 A * 10/1998 Ricks et al. ..... 280/618

* cited by examiner

*Primary Examiner*—Brian L. Johnson
*Assistant Examiner*—G B Klebe
(74) *Attorney, Agent, or Firm*—David G. Henry

(57) ABSTRACT

A device which connects a rider's boot or boot binding to a snowboard or other gliding board while allowing free rotation of the boot relative to the board during use. The base of the device is rigidly affixed to the board and a mounting disk is secured to the base preventing relative translation in all directions between the base and mounting disk, but allowing rotation of the mounting disk relative to the base about an axis perpendicular to the base. During relative rotation, the base and mounting disk remain in parallel planes. The mounting disk includes provisions to attach the rider's boot or boot binding to the mounting disk. The device employs load-bearing balls, load-bearing rollers and/or load-bearing surfaces. One or more springs or elastomeric materials can be installed, at the option of the rider, between the base and mounting disk to cause the mounting disk to return to a predetermined angular position relative to the base.

5 Claims, 5 Drawing Sheets

FREE SWIVELING MOUNT FOR SLIDING BOARD BOOT BINDINGS

This application claims the benefit of U.S. Provisional Application No. 60/112,253, filed Dec. 14, 1998.

BACKGROUND OF THE INVENTION

1. Field of the Invention

The present invention relates to attaching boot bindings to snowboards and more particularly to mounts that do not restrain free rotation of the boot or binding about an axis normal to the plane of the snowboard.

2. Description of the Prior Art

The sport of snowboarding has evolved rapidly in the past two decades manifested by the volume of patens issued and the variety of products marketed and in use by snowboard enthusiasts. New snowboard designs for distinctive riding styles, new attire for snowboard enthusiasts and new equipment for snowboard park grooming are all recent innovations in this increasingly popular sport. Perhaps the most innovative results of the sport are the stunts invented and performed by the riders themselves. Some of these stunts have been named for the riders who first popularized them.

One of the riding methods pioneered by snowboard enthusiasts is performing stunts with one of the rider's boots disengaged from the binding and board completely. This removes all contact between the board and one of the rider's feet except when the rider steps on top of the board with the unfastened boot. This also decreases the rider's control of the board, but allows new and different stunts to be performed. The disadvantage of this riding method is a greatly increased risk of injury to the rider. With both of the rider's boots attached to the board, any rotation of the board applies a moment about an axis through the center of mass of the rider's body. This rotation is therefore-reacted at the rider's waist as both legs rotate with the board. With the board attached to only one of the rider's legs, the board becomes a lever arm about an axis through the center of the rider's lower leg, much the same as a ski is attached to one leg only. The weak point in this application of twisting moment is the rider's knee. Knee injuries are common in skiing accidents and also threaten the snowboarder who rides with one foot unfastened from the board.

The initial objective of snowboard binding innovations was, and still is, to securely, safely and comfortably attach a rider's boots to a snowboard for optimal performance and enjoyment by rigidly affixing the rider's boots to the snowboard during use. Another objective of many snowboarding innovations if providing a quicker and more convenient method to fasten and unfasten the rider's boots or boot bindings to the board. Another objective is providing the capability to adjust the position, and more importantly, the angle of the binding relative to the snowboard centerline. The present invention does not address the objective of quick and convenient fastening/unfastening of the rider's boots. These convenient fastening methods and the present invention can be used simultaneously with the present, invention as it can be installed in series with the boot binding as an interface-between the boot binding and the board.

This objective of angular adjustment has been addressed in recent years, resulting in various mechanisms to change the binding position from one angular setting to another. The prior art includes several methods to adjust the angular setting of the boot bindings without removing the boot from the binding and without releasing or loosening the bindings securing the boot A dominant feature in these adjustable mechanisms is a lock or latch to prevent the angular setting from changing during use. In U.S. Pat. No. 5,499,837 a lever rotates a locking plate to prevent housing rotation. A locking pin in the lever is spring loaded causing a positive mechanical lock during use. In U.S. Pat. No 5,520,405 the binding is only allowed to rotate 90 degrees with a stopping means to hold it in the locked position. In U.S. Pat. No. 5,667,237 a releasable latch is used to manually disengage a rotatable serrated disk, but is spring loaded to provide a mechanical lock when not manually held. In U.S. Pat. No. 5,732,959 a method for rotating bindings is shown for the purpose of determining optimal fixed angular settings for each rider before use. In U.S. Pat. No. 5,762,358 a swivelable binding which can rotate through a 90 degree range employs a handle-operated locking mechanism to prevent rotation of the binding during use. In U.S. Pat. No. 5,765,853 anti-pivot spring pins secure the angular setting during use. In addition to providing locking features, all prior art either limits the amount of total rotation to a finite angular range or provides a finite number of predetermined angular setting with the use of notches, serrations or holes to engage locking mechanisms.

Heretofore there has not been available a boot binding mount for sliding boards with the advantages and features of the present invention.

SUMMARY OF THE INVENTION

The present invention fixes five of these degrees of freedom for each foot while allowing free rotation of each foot about an axis normal to the plane of the board. The present invention will provide secure attachment of the rider's boot or boot binding to the board and allow the rider to pivot his/her foot about an axis normal to the board while riding, walking or performing stunts on the snow surface or in the air. The rider can rotate both feet simultaneously or rotate each foot independent of the other while attached to the board. Although the present invention allows rotation of each foot, the board can not apply a twisting moment to one of the rider's legs as in the case of a snow ski. Any large rotation of the board will still be about an axis through the rider's center of mass and reacted by the rider's waist. The present invention will multiply the possibilities for varieties of maneuvers and new stunts to be performed.

A coil spring, linear spring, or elastomeric members can be incorporated to cause the swiveling mount to return to a predetermined angular setting. This angular setting and force (spring constant) can be set to the preference of the rider.

Many of the locking or latching mechanisms of prior art documented in the section above can be incorporated into this free swiveling mount. This combination can provide a dual purpose snowboard mount allowing the rider to selectively switch to and from a swiveling and fixed angular setting riding style and without changing boards or bindings.

DETAILED DESCRIPTION OF THE INVENTION

I. INTRODUCTION AND ENVIRONMENT

Figure 1:
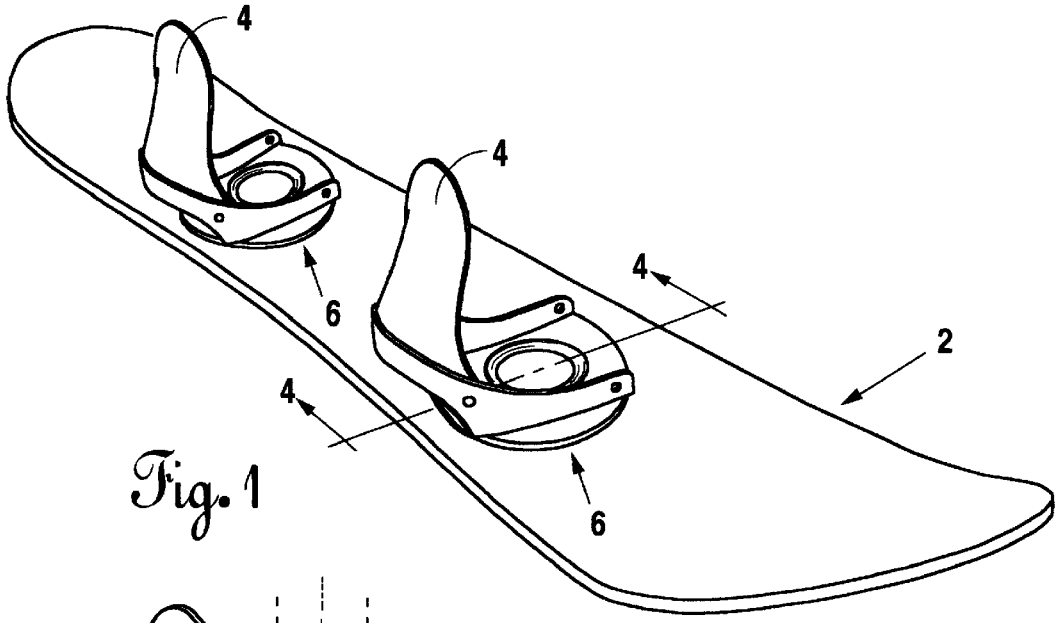
FIG. 1 is a perspective view of a snowboard with bindings mounted by the swivel mount of the present invention.

Referring to the drawings in more detail, the reference numeral 2 generally designates a sliding board, e.g. a snowboard with bindings for mounted thereon by swivel mounts 6 embodying the present invention.

II. SWIVEL MOUNT 6

Each swivel mount 6 includes a base 8 and a mounting disk 10. The base 8 and the mounting disk 10 are rotatable by means of load bearing ball bearings 14 in captive raceways 16, 18 formed in the base 8 and the mounting disk 10 respectively. The balls 12 react tensile and compressive loads. The balls 12 also react forces caused by an out of plane moment which is any moment about an axis that lays in the plane or parallel plane of the board 2. The swivel mount 6 restricts all relative motion between the base 8 and mounting disk 10 except the free rotation of the base 8 and mounting disk 10 in parallel planes while any combination of tensile, compressive or out of plane moments are being randomly applied.

The balls 12 may be installed by aligning the raceways 16, 18 nonconcentrically to create a crescent shaped gap on one side large enough to admit the balls 12. Half of a full complement of balls 12 may be installed in this manner. The balls 12 may also be installed through a hole 20 in one of the raceways 16, 18. This ball filling hole 20 is sealed by a threaded plug 22.

Balls 12 are preferred over sliding surfaces as a small amount of melted snow (water) can fill small gaps and readily refreeze effectively locking surfaces which are close together. A larger volume of water is required to fill the space between balls 12 in a bearing race or groove. Small collections of ice or ice and snow (in those spaces) are thus more readily crushed by the rolling motion of the balls or rollers.

Figure 3:
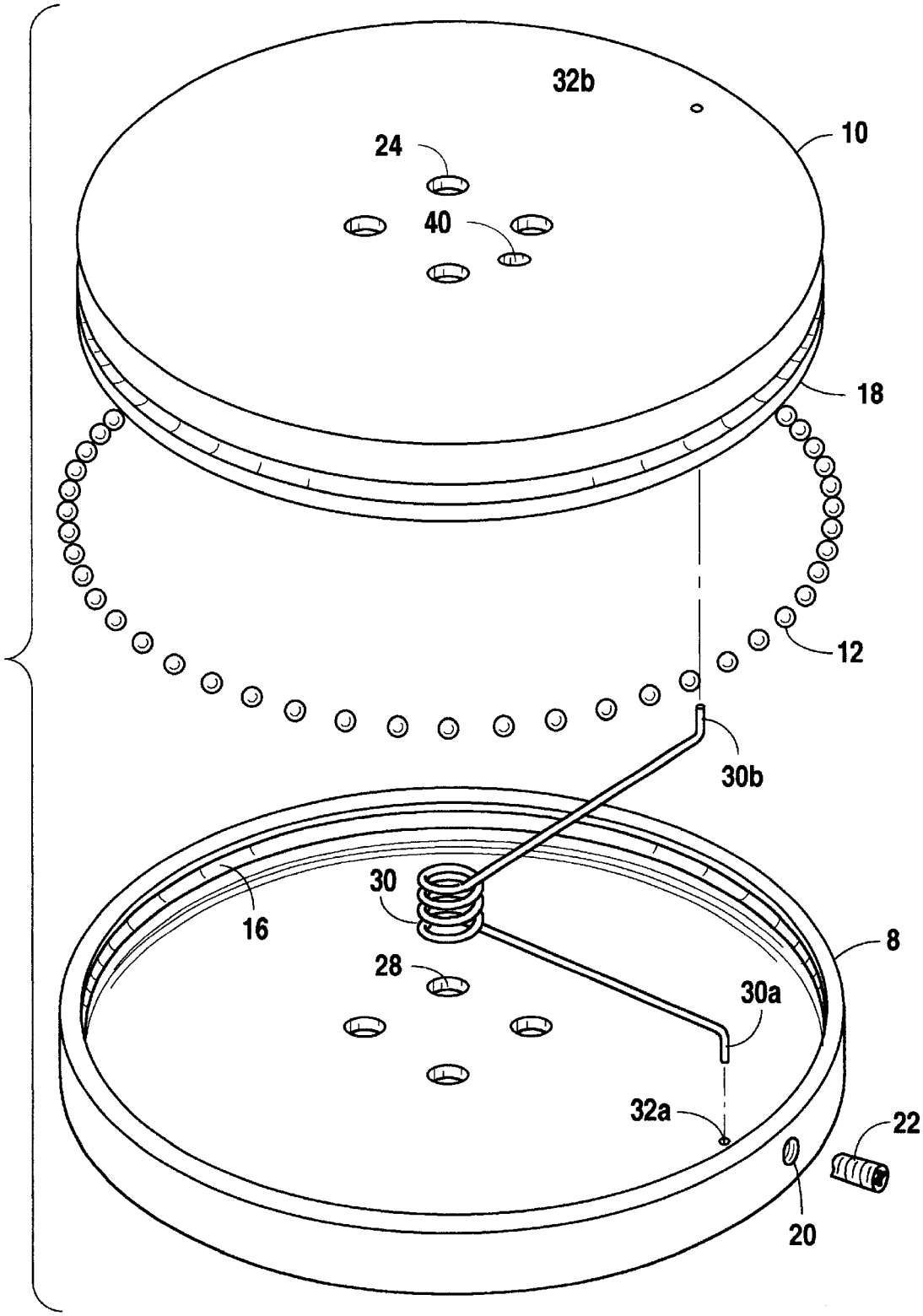
FIG. 3 is an exploded view of the swivel mount.

As shown in FIG. 3, the base 8 and mounting disk 10 are round, have integral raceways 16, 18 for load bearing balls 12 and have an identical pattern of holes 24 for fasteners 26. The hole pattern shown is intended to match the fastener pattern provided by the original equipment manufacturers of snowboards. The inner raceway 18 is machined into the mounting disk 10. The outer raceway 16 is machined or formed with the threaded plug 22 fully installed in the base 8. The raceway dimensions should be net size of the ball 12 outer dimensions. Tolerance (gap) is not desirable between the raceways 16, 18 and ball 12 dimensions. A slight pre-load (interference) is preferred between the raceways 16, 18 and balls 12. The raceways 16, 18 should be standard deep groove or four-point contact type.

Lower fasteners 26 are placed in fastener holes 28 and are held in place during assembly by tape wrapped around the protruding threaded ends. The base 8 and mounting disk 10 are placed together. A torsion spring 30 with torsion spring ends 30*a,b* received in end receivers 32*a,b* may be installed (at the option of the rider) when the base 8 and mounting disk 10 are placed together. The plug 22 is removed and the balls 12 are installed. Ball separators, spacer balls or bearing cages may be installed in between each of the balls 12 to achieve the desired number of balls 12 around the entire raceway periphery. The plug 22 is then replaced to form the complete and captive raceway.

Figure 2:
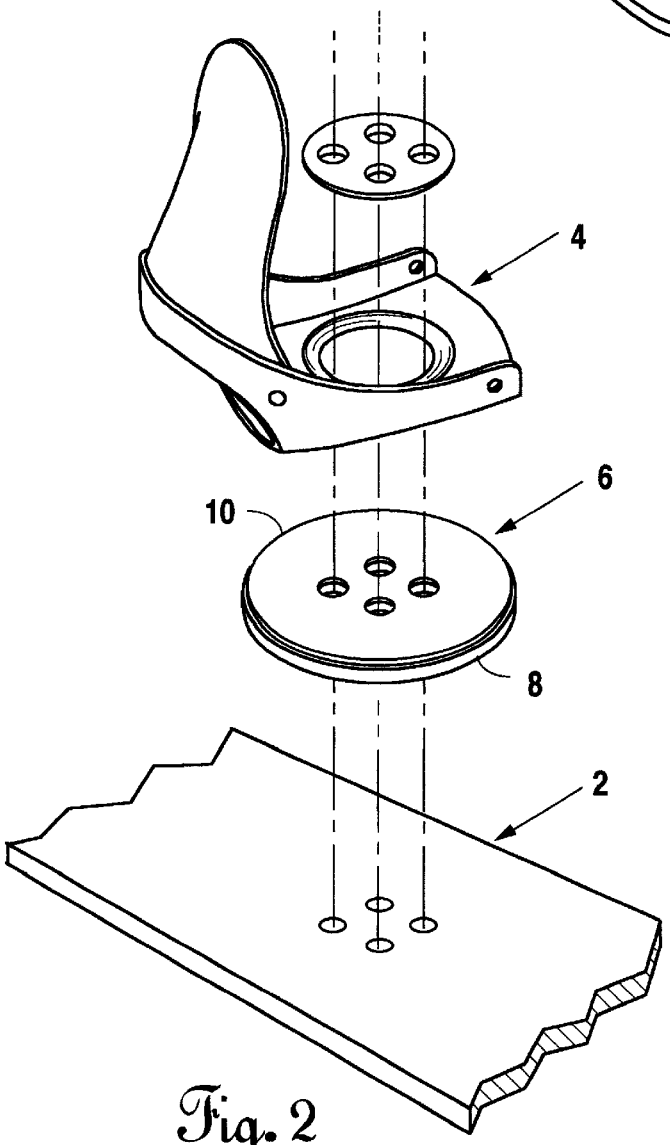
FIG. 2 is an exploded view of the snowboard, binding and the swivel mount.

After the tape is removed from the threaded lower fasteners 26, each of the lower fasteners 26 can be tightened into the board by placing the tool through the tool access hole 40 and rotating the mounting disk to align the tool with each fastener 26. The centerlines 34 shown in FIG. 2 represent the eight fasteners 26, 36 required to install the swivel mount 6. The boot bindings 4 can be fastened (e.g., by upper fasteners 36 and/or alternative upper fasteners 38) to the mount by a recessed tool and wrench. FIG. 1 shows the board 2 with a swivel mounts 6 and bindings 4 installed.

Should a rider desire to have only one foot free to swivel, only one swivel mount 6 can be installed on the binding 4 specified by the rider. The other binding 4 should have a spacer of a thickness identical to that of the swivel mount 6 installed under the other binding. These spacers are commercially available and serve the purposed of raising the rider's boots higher above the snow to decrease the occurrence of "toe drag." The combination of long feet and narrow boards causes the rider's toe end of the boots to protrude beyond the edge of the board 2. When the rider leans forward during a turn, the protruding boots may drag or catch on the snow surface causing decreased performance or the rider to fall.

Figure 4:
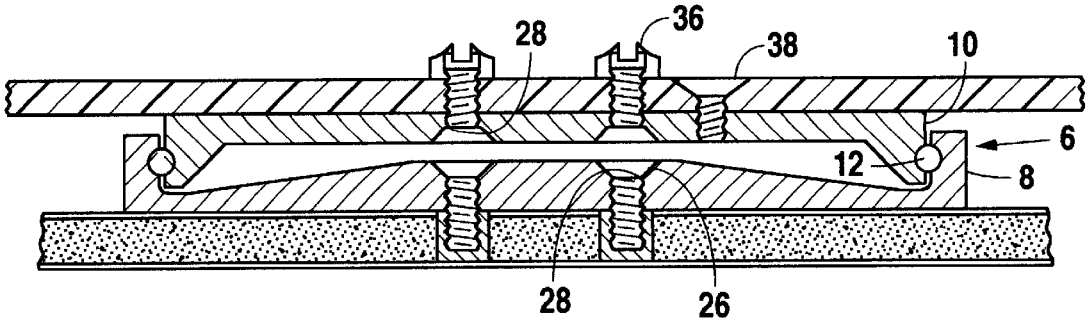
FIG. 4 is a vertical, cross-sectional view thereof, taken generally along line 4—4 in FIG. 1.

A sectional view of the completely installed swivel mount 6 is shown in FIG. 4. The type of fasteners 26, 36, 38 used will depend on dimensional constraints, the type of materials used and requirements of manufacturing processes.

III. FIRST MODIFIED EMBODIMENT SWIVEL MOUNT 106

Figure 5:
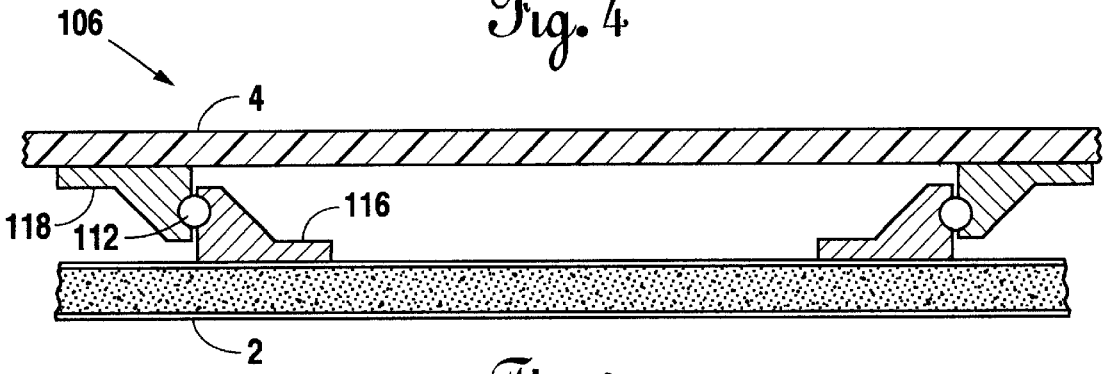
FIG. 5 is a vertical, cross-sectional view of a swivel mount for a snowboard binding comprising a first modified embodiment of the present invention.

FIG. 5 shows a swivel mount 106 comprising a first modified embodiment of the present invention. The swivel mount 106 includes base (lower) and mounting disk (upper) raceways 116, 118. The raceways 116, 118 are rotatably interconnected by ball bearings 112.

IV. SECOND MODIFIED EMBODIMENT SWIVEL MOUNT 206

Figure 6:
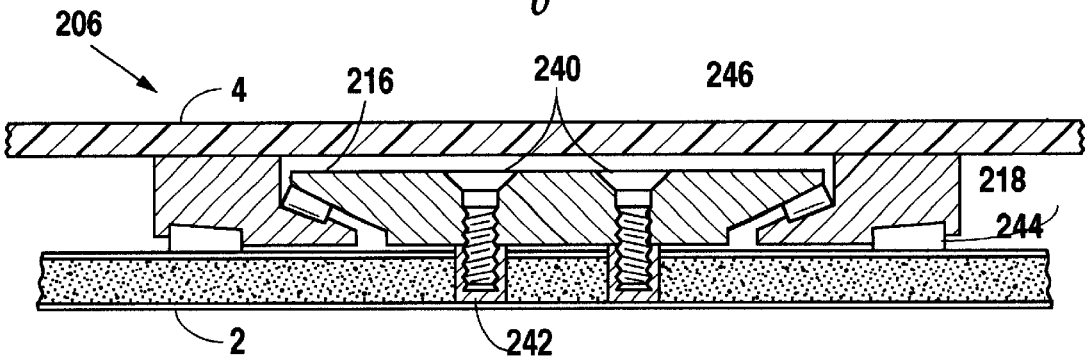
FIG. 6 is a vertical, cross-sectional view of a swivel mount for a snowboard binding comprising a second modified embodiment of the present invention.

A swivel mount 206 comprising a second modified embodiment of the present invention is shown in FIG. 6 and includes a base raceway 216 mounted on the snowboard 2 by means of fasteners 240 received in threaded insets 242 and a mounting disk raceway 218 mounted on the binding 4. A set of raceway/snowboard rollers 244 rotatably interconnect the mounting disk raceway 218 and the snowboard 2. An array of raceway front/raceway rollers 246 rotatably interconnect the raceways 216, 218.

V. THIRD MODIFIED EMBODIMENT SWIVEL MOUNT 306

Figure 7:
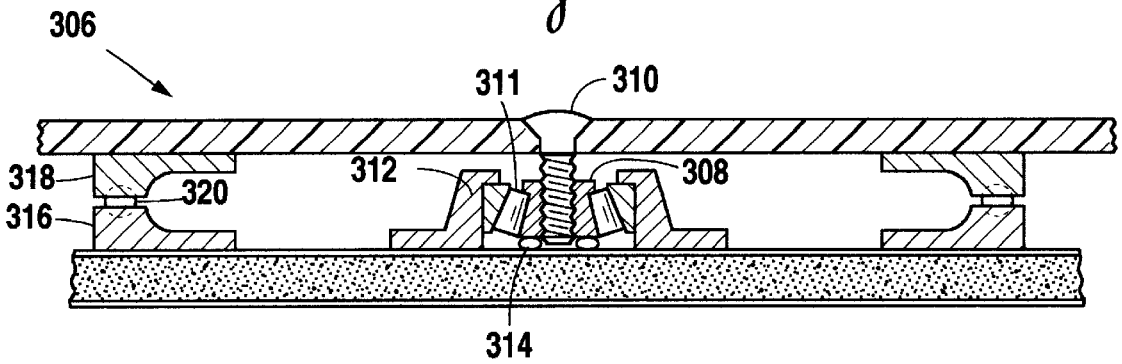
FIG. 7 is a vertical, cross-sectional view of a swivel mount for a snowboard binding comprising a third modified embodiment of the present invention.

A swivel mount 306 comprising a third modified embodiment of the present invention is shown in FIG. 7 and utilizes a "center post" configuration with an annular, tapered roller bearing assembly 308 connected to the boot binding 4 by an axial fastener (e.g., a bolt or machine screw) 310. The bearing assembly 308 includes tapered roller bearings 311 and is retained in place by an annular bearing retainer 312 mounted on the snowboard 2. Pin rollers 314 are located between the bearing assembly 308 and the snowboard 2. Outer, annular lower and upper raceways 316, 318 are mounted on the snowboard 2 and the binding 4 and are rotatably interconnected by ball bearings 320. Alternatively, the ball bearings 320 can be omitted and the lower and upper raceways 316, 318 can rotatably slide with respect with each other.

VI. FOURTH MODIFIED EMBODIMENT SWIVEL MOUNT 406

Figure 8:
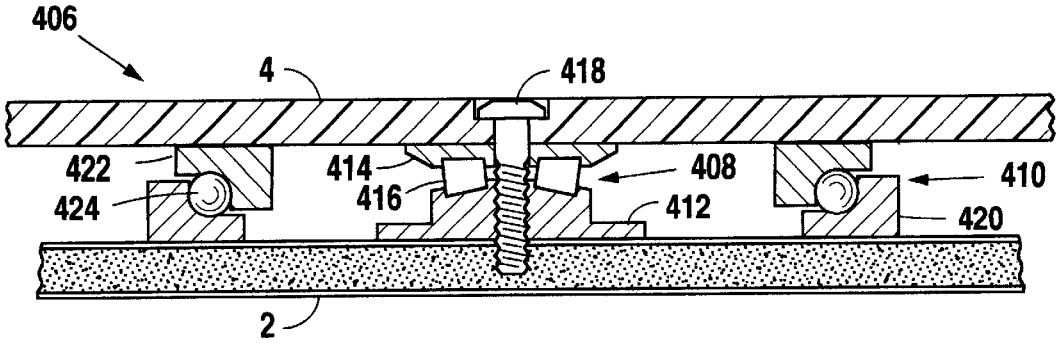
FIG. 8 is a vertical, cross-sectional view of a swivel mount for a snowboard binding comprising a fourth modified embodiment of the present invention.

A swivel mount 406 comprising a fourth embodiment of the present invention is shown in FIG. 8. The swivel mount 406 includes inner and outer annular bearing assemblies 408, 410. The inner bearing assembly 408 includes a lower front/raceway 412 and an upper front/mounting disk raceway 414 rotatably interconnected by tapered roller bearings 416. An axial fastener 418 secures the binding 4 to the snowboard 2 and extends coaxially through the inner bearing assembly 408. The outer bearing assembly 410 includes a lower front/base raceway 420 and an upper front/mounting disk raceway 422 mounted on the snowboard 2 and the binding 4 respectively and rotatably interconnected by ball bearings 424.

VII. FIFTH MODIFIED EMBODIMENT SWIVEL MOUNT 506

Figure 9:
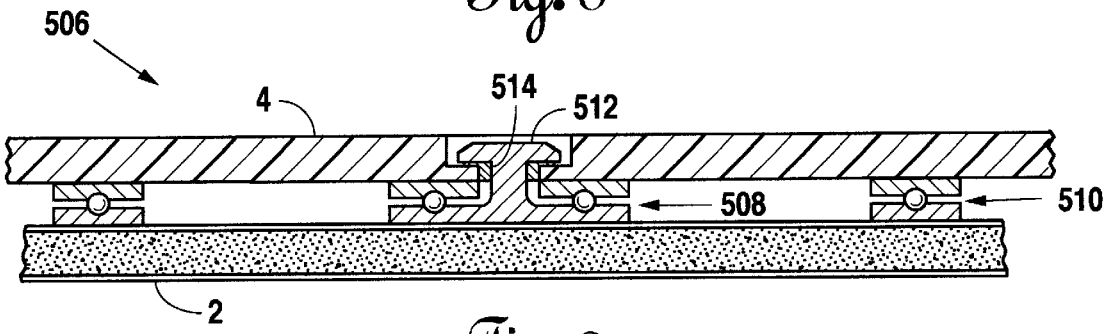
FIG. 9 is a vertical, cross-sectional view of a swivel mount for a snowboard binding comprising a fifth modified embodiment of the present invention.

A swivel mount 506 comprising a fifth modified embodiment of the present invention is shown in FIG. 9 and includes an inner bearing assembly 508 and an outer bearing assembly 510. The inner bearing assembly 508 includes an axial fastener front/raceway subassembly 512 coaxially mounted on the snowboard 2 and rotatably received in the binding 4 by means of a bushing 514. The swivel mount 506 provides a relatively low profile whereby the binding 4 is located relatively close to the snowboard 2.

VIII. SIXTH MODIFIED EMBODIMENT SWIVEL MOUNT 606

Figure 10:
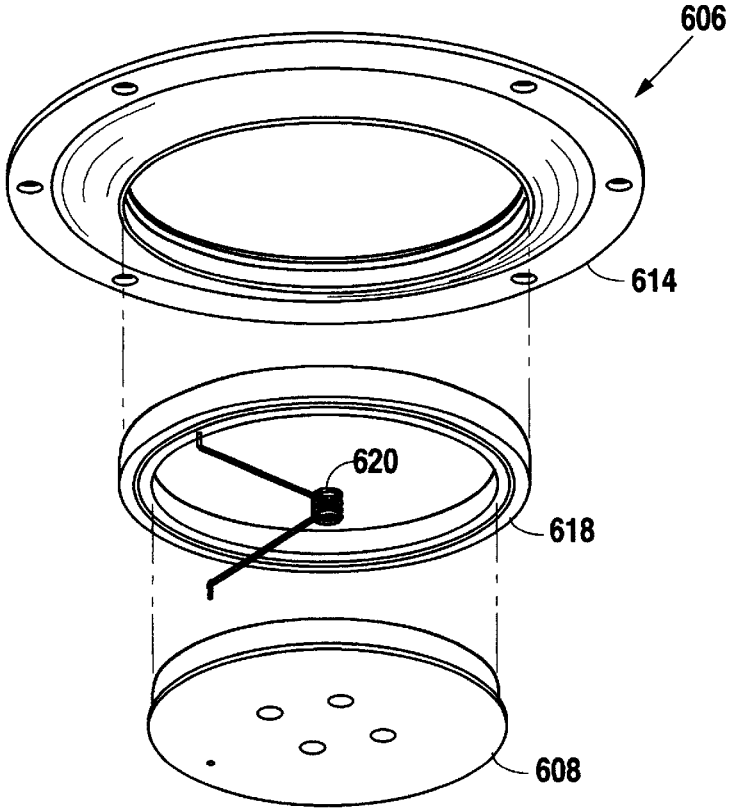
FIG. 10 is an exploded view of a swivel mount for a snowboard binding comprising a sixth modified embodiment of the present invention.
Figure 11:
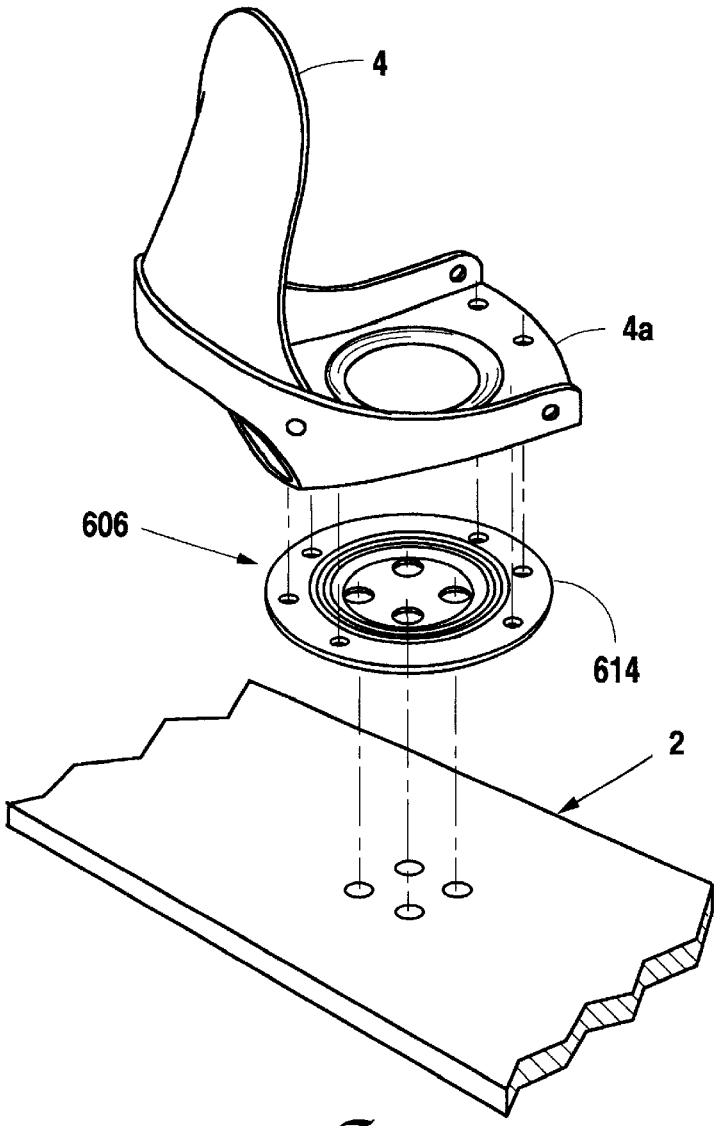
FIG. 11 is an exploded, perspective view of the sixth modified embodiment swivel mount, shown with a snowboard and a boot binding.
Figure 12:
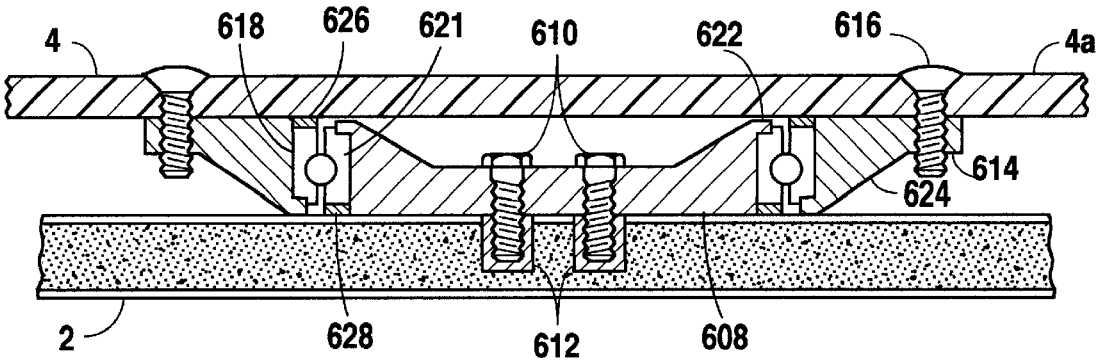
FIG. 12 is a vertical, cross-sectional view of the sixth modified embodiment swivel mount for a snowboard binding.

A sixth modified embodiment swivel mount 606 is shown in FIGS. 10–12 and includes a base 608 mounted on the snowboard 2 by fasteners (e.g., bolts) 610 threadably received in threaded inserts 612 embedded in the snowboard 2. An annular mounting disk 614 is mounted on the bottom flange 4*a* of the boot binding 4 by suitable binding/mounting disk fasteners (e.g., machine screws) 616. An annular bearing 618 is captured between the base 608 and the mounting disk 614 and accommodates relative rotation there between. An optional torsional spring 620, similar to the torsional spring 30 described above, interconnects the base 608 and the mounting disk 614 for biasing same to a predetermined rotational orientation with respect to each other.

The bearing 618 can be press-fit into the mounting disk 614 and the base 608 may be press fit into the receiver 621 of the bearing 618. The bearing 618 may be held in place by interference or captured by flanges 622 and 624 on the base 608 and mounting disk 614 respectively. An upper annular spacer 626 may be inserted between the bearing 618 and the bottom flange 4*a* of the boot binding 4 in order to prevent the bearing 618 from slipping and causing interference between the mounting disk 614 and the sliding board 2. A lower annular spacer 628 placed between the bearing 618 and the sliding board 2 serves the same purpose.

It is to be understood that while certain forms of the present invention have been illustrated and described herein, it is not to be limited to the specific forms or arrangement of parts described and shown.

What is claimed and desired to be secured by Letters Patent is as follows:

1. A swivel mount for mounting a binding on a sliding board, which comprises:

a) a base mounted on the board;

b) amounting disk:mounted on the binding; and c) bearing means rotatably interconnecting said base and said mounting disk and adapted to provide relative rotation therebetween, said bearing means including a bearing assembly with a first race connected to said base, a second race connected to said mounting disk and a plurality of bearings rotatably interconnecting said races;

d) a torsional spring with first and second ends connected to said base and said mounting disk respectively.

2. The swivel mount according to claim 1 wherein said base includes a receiver receiving said spring first end and said mounting disk includes a receiver receiving said spring second end.

3. A swivel mount for mounting a binding on a sliding board, which comprises:

a) a base mounted on the board;

b) a mounting disk mounted on the binding; and c) bearing means rotatably interconnecting said base and said mounting disk and adapted to provide relative rotation therebetween, said bearing means including an annular bearing assembly which is press fit into a receiver in said mounting disk and said base is a circular member which is press fit into the center of said annular bearing assembly.

4. The swivel mount according to claim 3 wherein said annular bearing assembly is captured by flanges on said mounting disk and said base.

5. The swivel mount according to claim 4 wherein an upper annular spacer is located between said annular bearing assembly and said binding, and a lower annular spacer is located between said annular bearing assembly and said sliding board.

* * * * *